US009747820B2

(12) United States Patent
Sanders

(10) Patent No.: US 9,747,820 B2
(45) Date of Patent: Aug. 29, 2017

(54) SYSTEMS AND METHODS FOR DISPLAYING ILLUMINATED IMAGES

(75) Inventor: Gerald R. Sanders, Oakley, UT (US)

(73) Assignee: Lifetime Products, Inc., Clearfield, UT (US)

( * ) Notice: Subject to any disclaimer, the term of this patent is extended or adjusted under 35 U.S.C. 154(b) by 448 days.

(21) Appl. No.: 12/790,521

(22) Filed: May 28, 2010

(65) Prior Publication Data

US 2010/0319227 A1 Dec. 23, 2010

Related U.S. Application Data

(60) Provisional application No. 61/183,354, filed on Jun. 2, 2009.

(51) Int. Cl.

| | |
|---|---|
| ***G09F 13/18*** | (2006.01) |
| ***G09F 13/22*** | (2006.01) |
| ***G09F 7/10*** | (2006.01) |
| ***G09F 23/00*** | (2006.01) |

(52) U.S. Cl.

CPC ..... *G09F 13/22* (2013.01); *G09F 7/10* (2013.01); *G09F 23/00* (2013.01); *G09F 2013/222* (2013.01); *G09F 2023/005* (2013.01)

(58) Field of Classification Search

USPC ..... 40/611.08, 611.1, 714; 362/130

See application file for complete search history.

(56) References Cited

U.S. PATENT DOCUMENTS

| | | | | |
|---|---|---|---|---|
| 4,974,354 | A * | 12/1990 | Hembrook, Jr. | 40/546 |
| 5,555,654 | A * | 9/1996 | Hermann | 40/714 |
| 6,256,811 | B1 * | 7/2001 | Nelson | 5/53.1 |
| 6,658,677 | B2 * | 12/2003 | Paul | 5/280 |
| 7,186,015 | B2 * | 3/2007 | Kimmet et al. | 362/630 |
| 7,281,834 | B2 | 10/2007 | Sinofsky | |
| 7,679,888 | B2 * | 3/2010 | Kirschner et al. | 361/679.01 |
| 2002/0007576 | A1 * | 1/2002 | Gai | 40/546 |
| 2002/0166272 | A1 * | 11/2002 | Gaymon | 40/575 |
| 2004/0074129 | A1 * | 4/2004 | Carlson | 40/714 |
| 2006/0150463 | A1 * | 7/2006 | Kim et al. | 40/725 |
| 2008/0101058 | A1 * | 5/2008 | Smith | 362/130 |
| 2010/0011638 | A1 * | 1/2010 | Choi | 40/446 |

FOREIGN PATENT DOCUMENTS

KR WO2008032968 * 3/2008

* cited by examiner

*Primary Examiner* — Kristina N Junge
(74) *Attorney, Agent, or Firm* — Maschoff Brennan

(57) ABSTRACT

Disclosed herein are systems and methods for displaying illuminated images. In some embodiments a light box is capable of receiving a wide variety of images, which may be changed as desired by a user. The light box may be framed independently for wall hanging or display on a stand, or incorporated within or attached to pieces of furniture, including but not limited to beds, dressers, changing tables, book shelves, chests of drawers, toy chests, and the like. In various embodiments, the light box may include a dimmer, a timed dimmer, a motion sensor, and/or equipment for playing music or generating white noise. In certain embodiments, a single light box may be used, while in other embodiments a plurality of light boxes and/or digital picture frames may be used.

20 Claims, 6 Drawing Sheets

SYSTEMS AND METHODS FOR DISPLAYING ILLUMINATED IMAGES

CROSS-REFERENCE TO RELATED APPLICATIONS

This application claims the benefit of U.S. Provisional Application No. 61/183,354, filed Jun. 2, 2009, which is fully incorporated herein by reference.

TECHNICAL FIELD

The present disclosure relates generally to systems and methods for illuminating images. In certain embodiments as described herein, an image to be illuminated is affixed, printed, or otherwise transferred onto a graphic panel, and the graphic panel is placed within or adjacent to a light source. The light source and graphic panel may be framed independently for wall hanging or display on a stand, or incorporated within or attached to furniture.

DETAILED DESCRIPTION OF PREFERRED EMBODIMENTS

Disclosed herein are systems and methods for displaying and changing illuminated images. In some embodiments a light box is capable of receiving a wide variety of images. Using the systems described herein, the images may be changed as desired by a user. The light box may be displayed independently of furniture, or may be attached to, placed adjacent to, or incorporated into pieces of furniture, including but not limited to beds, dressers, changing tables, book shelves, chests of drawers, toy chests, and the like. In various embodiments, the light box may include a dimmer, a timed dimmer, a motion sensor and/or equipment for playing music or generating white noise. In certain embodiments, a single light box may be used, while in other embodiments a plurality of light boxes and/or digital picture frames may be used.

Figure 1:
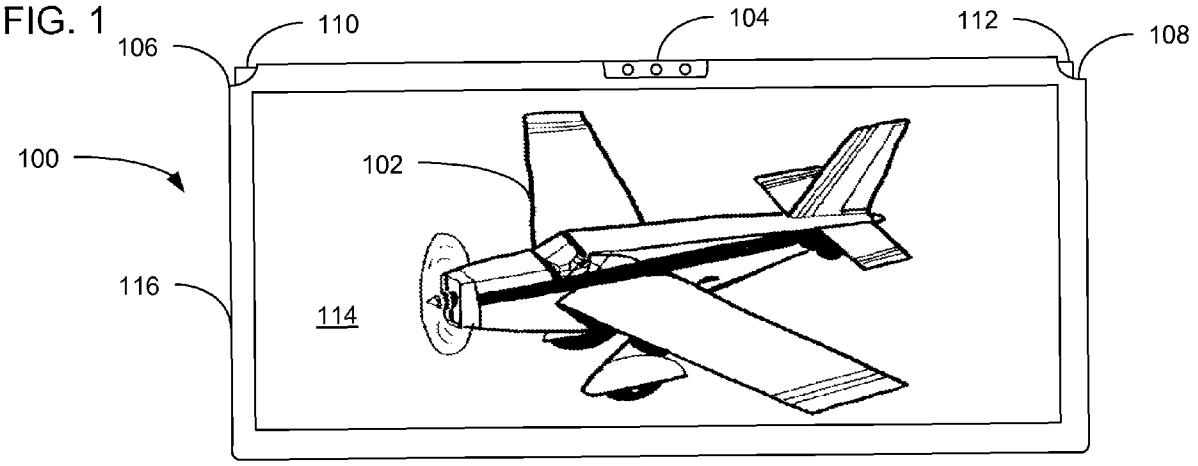
FIG. 1 is a front view of one embodiment of a light box for displaying an illuminated image, and illustrates corner cutouts for image removal and replacement.

With reference now to the accompanying drawings, FIG. 1 is a front view of a light box 100 displaying a first image 102. Image 102 is imprinted on a graphic panel 114, which may be removed from light box 100 and other graphic panels having different images may be inserted. A wide range of images may be available, and a user may select an image that is to his or her liking. Graphic panel 114 provides a backing material on which image 102 is imprinted. Light box 100 is configured to receive graphic panel 114. In certain embodiments, a suitable graphic panel 114 comprises Duratrans®, a durable transparency available from Eastman Kodak Company, Rochester, N.Y. Other suitable materials for graphic panel 114 are also contemplated.

Figure 2:
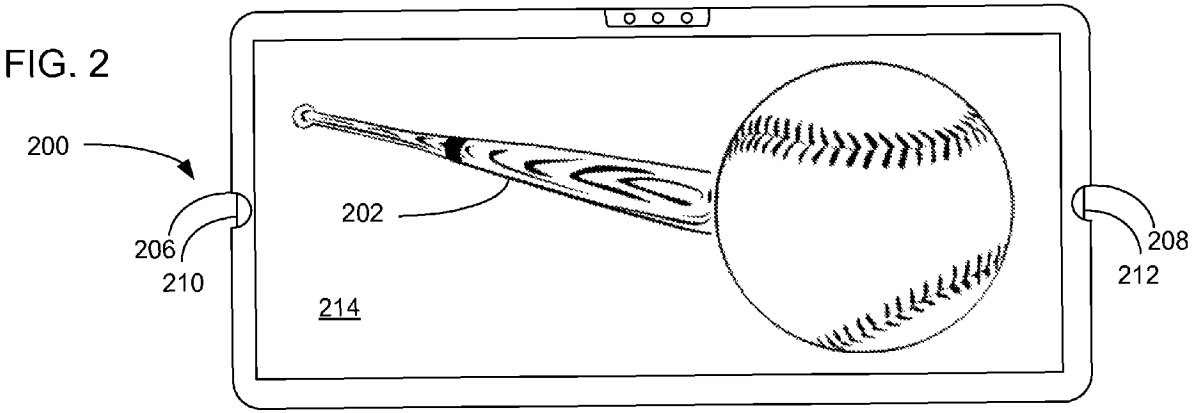
FIG. 2 is a front view of one embodiment of a light box for displaying an illuminated image, and illustrates side cutouts for image removal and replacement.

Light box 100 is configured to allow a user to easily change one image for another. In one embodiment, notches 106 and 108 are placed at the corners of a frame 116, and the corners 110 and 112 of the graphic panel 114 extend beyond notches 106 and 108. A user may grasp corners 110 and 112 in order to extract graphic panel 114 (including image 102) from light box 100. One or more notches may be placed in locations other than the corners. For example, one or more notches may also be placed along the top edge of frame 116. FIG. 2 illustrates another embodiment in which a second image 202 may be inserted into a light box 200 in place of image 102. Second image 202 is printed on a graphic panel 214. In the embodiment illustrated in FIG. 2, light box 200 has notches 206 and 208 on its sides, and graphics panel 214 may be removed from the side of light box 200.

Returning to a discussion of FIG. 1, light box 100 contains a light source for illuminating the image to be displayed. A variety of types of light sources are contemplated. In certain embodiments, the light source comprises a plurality of light emitting diodes (LED). An LED light source advantageously produces a relatively small amount of heat and consumes a relatively small amount of electricity. A 12 volt power source may be utilized to power the LED light source. In other embodiments the light source may be embodied as a fluorescent lamp, a cold cathode lamp, an electroluminescent panel, a neon tube, an incandescent bulb, and the like.

In various embodiments, light box 100 may be edge lit or back lit. In edge lit embodiments the light source is disposed along one or more edges of the light box. In back lit embodiments, the light source is disposed behind the image. Various techniques may be employed to evenly illuminate the image, both in embodiments that are edge lit and in embodiments that are back lit.

A control panel 104 may be used to control light box 100. Control panel 104 may be used to turn on or turn off the light source in light box 100. In certain embodiments, a dimmer function is also provided. The dimmer function allows the intensity of the light source to be decreased to a desired level, or to be decreased automatically over a specified time interval (e.g. 30 minutes). The dimmer may allow light box 100 to be turned on, for example, when a child is going to sleep. The intensity of the light source may then decrease gradually over time and eventually turn off after the child has had sufficient time to fall asleep. In other embodiments, light box 100 may include an alarm clock, which may gradually increase the illumination provided by the light source at a specified time in order to wake a user. In other embodiments, light box 100 includes one or more speakers and a music player or a docking system for a portable music player. In both the dimmer and alarm clock modes, music or white noise may be played. In certain embodiments, control panel 104 allows a user to control the portable music player. In additional embodiments, control panel 104 may contain an infrared control device enabling remote operation of on/off, dimmer, and music functions with a remote control. In still other embodiments, the control panel may contain a motion sensor devised to turn on an illumination when activated by someone entering a room in which the light box is used. The controls of control panel 104 may be touch switches and may incorporate both infrared and motion sensor technology.

Figure 3:
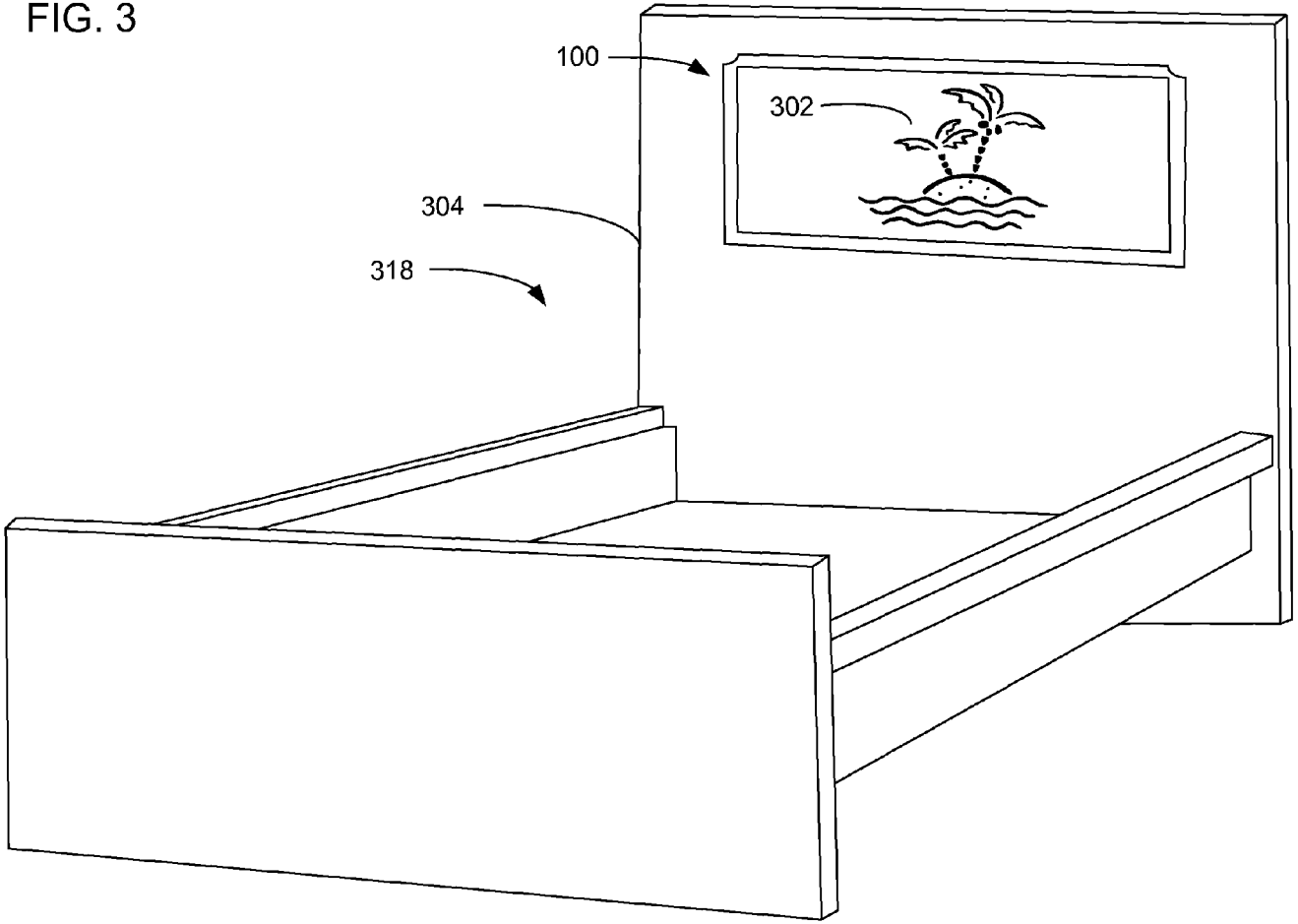
FIG. 3 is a perspective view of one embodiment of a bed having a headboard incorporating a light box.
Figure 8:
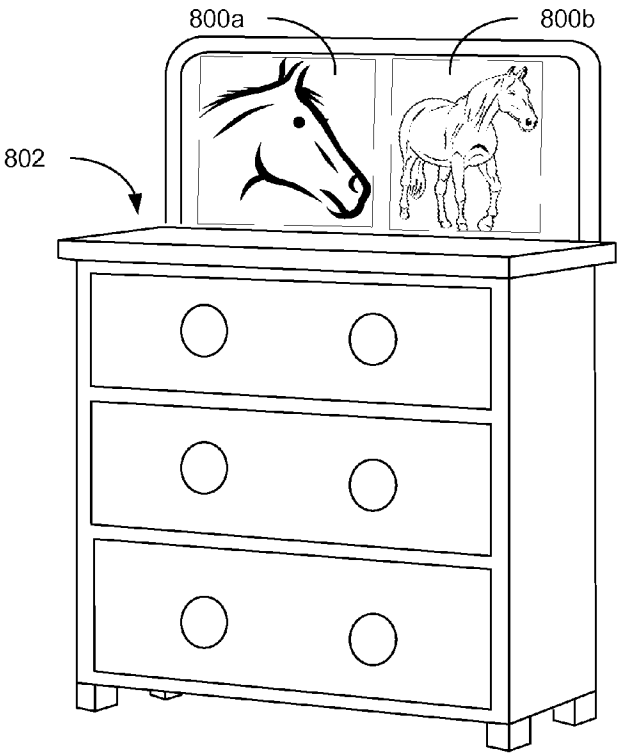
FIG. 8 illustrates a perspective view of one embodiment of a chest of drawers incorporating two light boxes.

FIG. 3 illustrates an embodiment of a bed 318 having a headboard 304 incorporating a light box 100. In the illustrated embodiment, light box 100 is built into headboard 304; in other embodiments, a light box may be attached to a wall independently of a bed, and may serve as a decorative headboard. An image 302 may be changed as desired in a manner similar to that described in connection with light box 100 illustrated in FIG. 1. In one embodiment, light box 100 measures 12 inches high by 32 inches wide. This size is suitable to attach to a headboard of a twin or full sized bed. Other sizes are also contemplated. For example, as illustrated in FIG. 8, two or more smaller light boxes may be used in place of a single larger light box. In still other embodiments, a digital picture frame may be used in place of or in connection with light box 100. By way of example, a bed may include two light boxes, each measuring 10 inches wide by 12 inches high, and may also include a digital picture frame having the same dimensions. It is further contemplated that a larger light box may be connected to larger beds.

Figure 4:
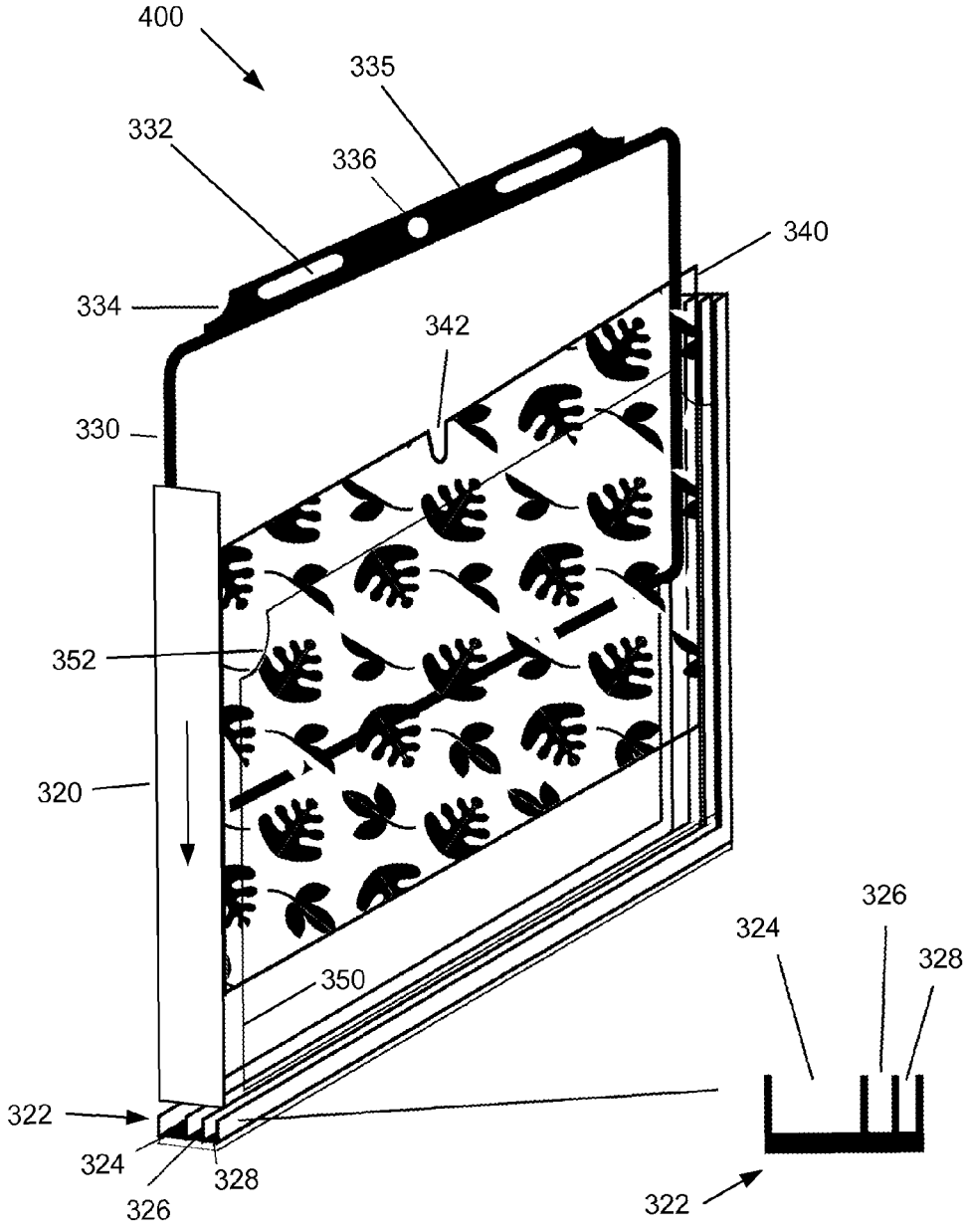
FIG. 4 illustrates a partially exploded view of a light box incorporating a track system utilized in displaying illuminated images.

FIG. 4 illustrates a cross sectional view of a light box 400 with a track system 322 for facilitating removal and replacement of a light panel 330, a graphic panel 340, and a protective cover 350. In this embodiment, tracks 324, 326, and 328 are fabricated and/or extruded from hardened plastic, rubber, aluminum, or wood within a frame 320. Tracks 324, 326, and 328 receive, respectively, a light panel 330, graphic panel 340, and protective cover 350. In the illustrated embodiment, light panel 330 is an edge-lit panel that is inserted into track 324. Light panel 330 includes an attached fin 335 with "grab" holes 332 to facilitate removal of the light panel 330 for service or replacement, and thumb hole 334 to facilitate removal of graphic panel 340. Light panel 330 further incorporates infrared receiver 336 for use with a remote control. In this embodiment, graphic panel 340 includes an image, and may be inserted into track 326. Track 326 is disposed in front of light panel 330 for illumination. Graphic panel 340 incorporates a cut out or notch 342 to accommodate the passing of the infrared light source needed for use with a remote control. Protective cover 350 protects the graphic panel 340 from scratching or other damage; it is inserted into track 328. In certain embodiments, protective cover 350 is made of clear acrylic. Other suitable materials are also contemplated. Protective cover 350 has thumb hole notches 352 in the top right and top left corners to facilitate removal of graphic panel 340.

Figure 5A:
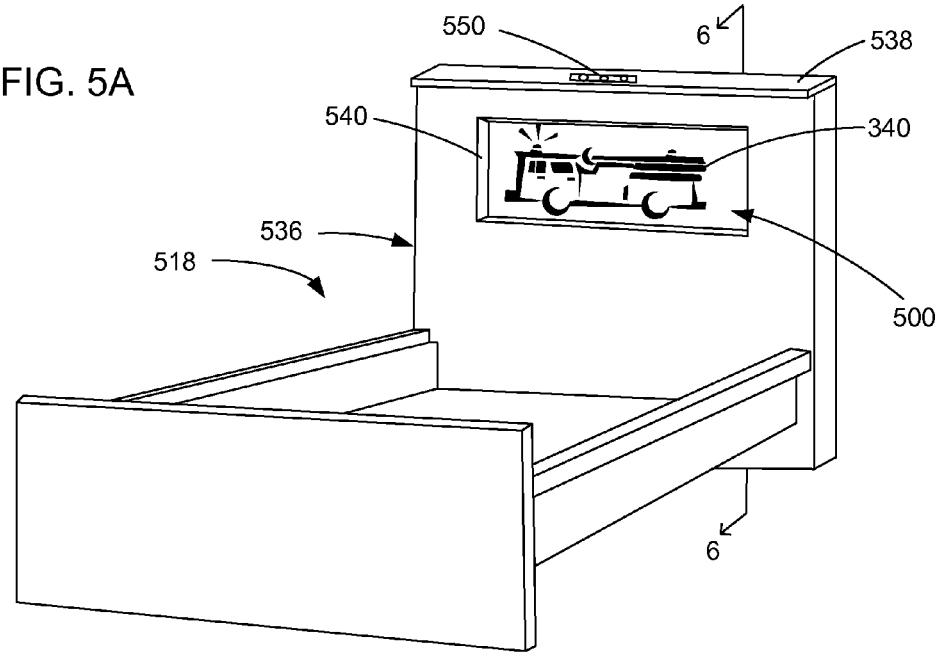
FIG. 5A illustrates a perspective view of one embodiment of a bed having a headboard enclosing a light box within an enclosure, and in which a lid of the enclosure is in a closed position.
Figure 5B:
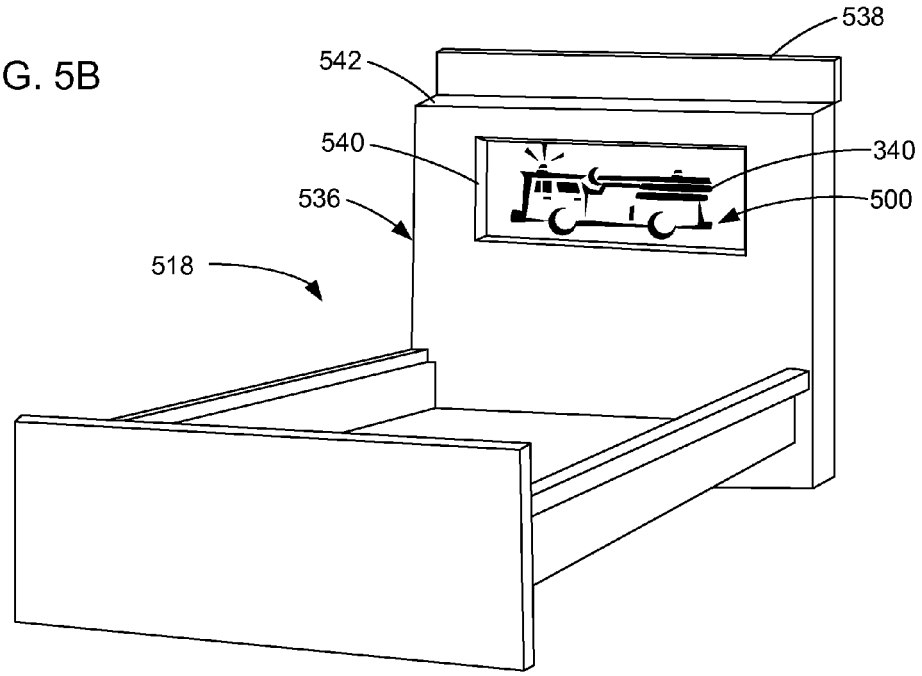
FIG. 5B illustrates a perspective view of the embodiment of the bed of FIG. 5A, in which the lid of the enclosure is in an open position.

FIGS. 5A and 5B illustrate a perspective view of one embodiment of a bed 518 having a headboard 536 enclosing a light box 500. Light box 500 is disposed within headboard 536. A graphic panel 340 having an image is held in light box 500. The image is visible through an aperture 540 in headboard 536. Along the top edge, headboard 536 includes an opening 542 and a lid 538. In a closed position, shown in FIG. 5A, lid 538 covers opening 542. In an open position, shown in FIG. 5B, lid 538 does not cover opening 542. A user may open lid 538 in order to change graphic panel 340. A hinge may connect lid 538 to headboard 536. A control panel 550 is disposed on lid 538 for controlling the operation of light box 500.

Figure 6:
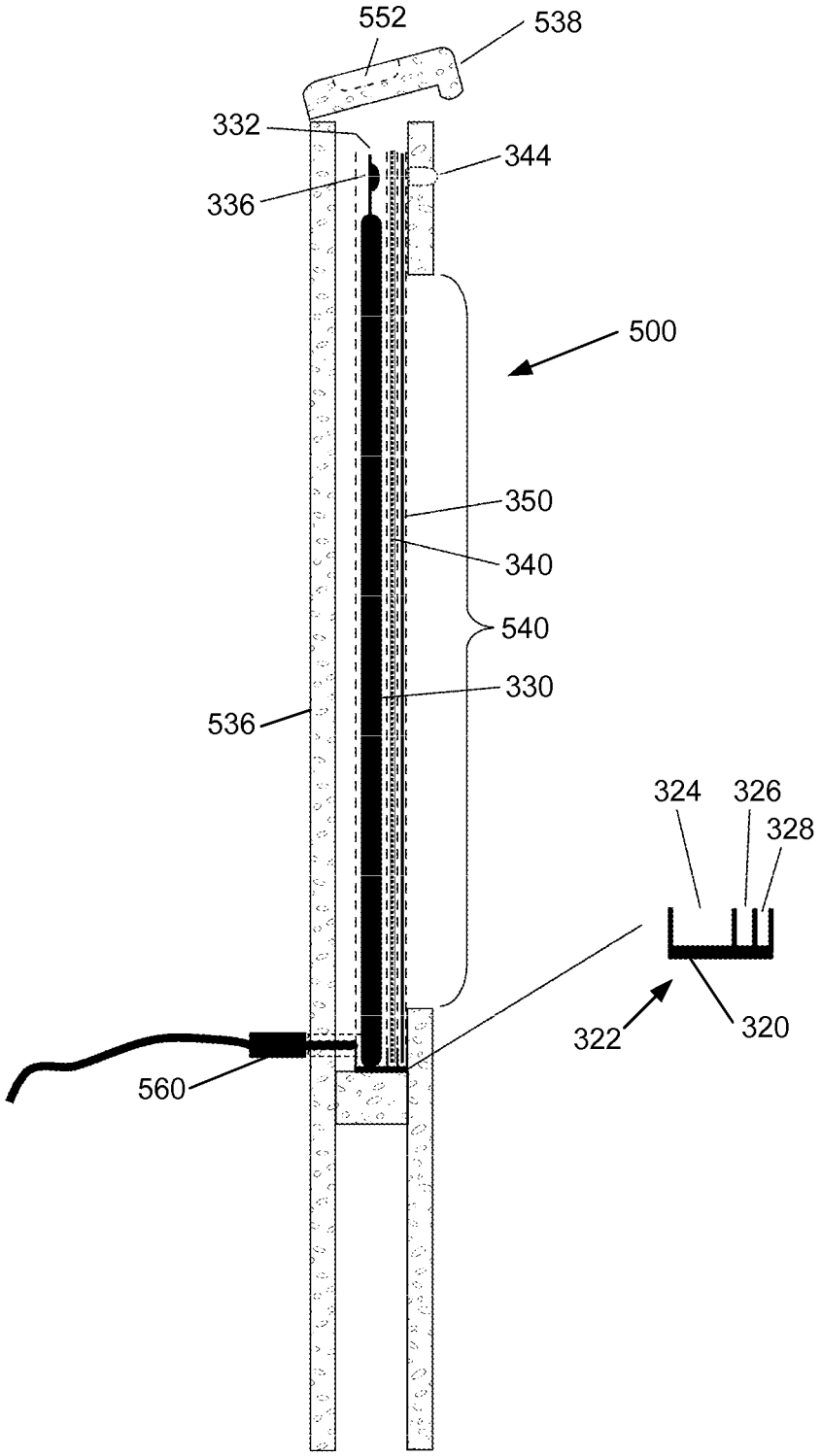
FIG. 6 illustrates a cross sectional view of the headboard illustrated in FIGS. 5A and 5B taken along line 6-6 of FIG. 5A.

FIG. 6 illustrates a cross sectional view of the light box and headboard in FIGS. 5A and 5B taken along line 6-6 in FIG. 5A. As illustrated, light box 500 is disposed within headboard 536. The image to be illuminated is visible through aperture 540. Light box 500 includes track system 322 discussed above in connection with FIG. 4. In this embodiment, touch switches disposed on control panel 550 may be employed for control of light box 500. Lid 538 may include a recessed area 552 for receiving control panel 550. In this embodiment, a removable electrical jack 560 may be employed as the connection from light panel 330 to a power source. Electrical jack 560 may be removed as necessary to service or replace light panel 330. An eye 344 accommodates the passing of an infrared signal to infrared receiver 336.

Figure 7:
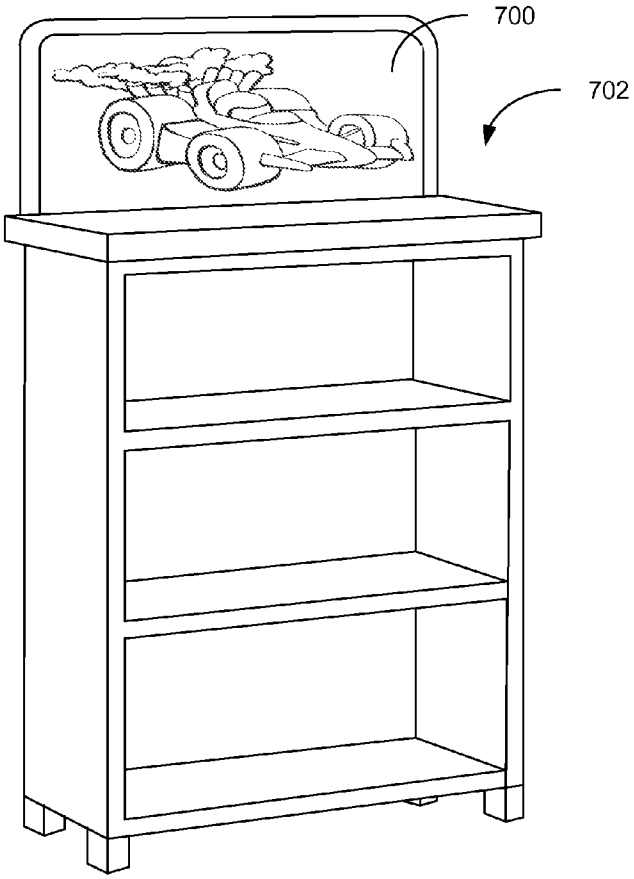
FIG. 7 illustrates a perspective view of one embodiment of a bookcase incorporating a light box with replaceable images.

The teachings of the present disclosure may be adapted to a wide variety of applications. By way of example, FIG. 7 illustrates a bookshelf 702 incorporating a light box 700. FIG. 8 illustrates a chest of drawers 802 incorporating two light boxes 800*a* and 800*b*. It is contemplated that a light box may also be attached to or incorporated into other pieces of furniture, including but not limited to changing tables, cribs, toy chests, and the like.

Those having skill in the art will recognize that many changes may be made to the details of the above-described embodiments without departing from the underlying principles of the present disclosure.

What is claimed is:

1. A headboard to display and illuminate an image, the headboard comprising:

an aperture located at a front of the headboard;

an opening located at a top of the headboard;

a track system comprising a first track, a second track, and a third track;

an image imprinted on a graphic panel, the graphic panel slidingly received within the second track via the opening, the graphic panel removable from the headboard via the opening;

a protective cover configured to be received within the first track, the protective cover configured to substantially cover the aperture and the image while the image is at least partially received within the second track; and a light panel including an edge-lit panel and a plurality of light emitting diodes, the light panel configured to be slidingly received within the third track via the opening and positioned behind the graphic panel, the light panel removable from the headboard via the opening such that the edge-lit panel and the plurality of light emitting diodes are together removed from the headboard via the opening as the light panel is removed from the headboard, the plurality of light emitting diodes of the light panel providing a sole source of illumination to the image from behind the graphic panel;

wherein the track system is positioned with respect to the aperture such that the image is at least partially visible through the aperture while the image is at least partially received within the second track.

2. The headboard of claim 1, further comprising a dimmer function which allows the intensity of the illumination provided to the image to be decreased to a desired level, or to be decreased automatically over a specified time interval.

3. The headboard of claim 2, further comprising a wireless control device configured to allow wireless manipulation of one or more functions provided by the light panel.

4. The headboard of claim 1, wherein the light panel is configured to removably couple with a removable electrical jack.

5. The headboard of claim 1, wherein the light panel is electrically powered by 12 volts.

6. An article of furniture, comprising:

a housing having an interior portion accessible via an opening formed in an edge of the housing;

an image imprinted on a graphic panel, the graphic panel received within the housing via the opening and in a manner such that at least a portion of the image is viewable through an aperture formed in a face of the housing, the graphic panel removable from the housing via the opening; and a light panel including an edge-lit panel and a plurality of light emitting diodes, the light panel received within the housing via the opening and positioned with respect to the graphic panel such that the plurality of light emitting diodes of the light panel provide a sole source of illumination to the image from the interior portion of the housing, the light panel removable from the housing via the opening such that the edge-lit panel and the plurality of light emitting diodes are together removed from the housing via the opening as the light panel is removed from the housing.

7. The article of furniture of claim 6, wherein the housing forms a portion of a headboard for a bed.

8. The article of furniture of claim 6, further comprising a hinged access that provides access to the opening.

9. The article of furniture of claim 6, further comprising a protective cover removably received within the housing via the opening and in a manner to substantially cover the image imprinted on the graphic panel.

10. The article of furniture of claim 6, further comprising one or more guiding mechanisms configured to removably receive at least one of the graphic panel and the light panel in a sliding fashion.

11. The article of furniture of claim 10, wherein the guiding mechanism comprises one or more tracks disposed within the interior portion of the housing.

12. The article of furniture of claim 6, further comprising a wireless control device configured to allow wireless manipulation of one or more functions provided by the light panel.

13. The article of furniture of claim 6, wherein the light panel further comprises a dimmer function which allows the intensity of the illumination to be changed to a desired level.

14. The article of furniture of claim 6, wherein the light panel further comprises a dimmer function which allows the intensity of the illumination to be changed automatically.

15. The article of furniture of claim 6, further comprising a digital picture display device configured so as to display an image via one of the aperture or a second aperture formed in the housing.

16. An article of furniture, comprising:

a housing having an interior portion accessible via an opening formed along an edge of the housing;

an image imprinted on a graphic panel, the graphic panel removably received within the housing via the opening and in a manner such that at least a portion of the image is viewable through an aperture formed in a face of the housing;

a protective cover received within the housing via the opening and in a manner to substantially cover the image imprinted on the graphic panel; and a light panel including an edge-lit panel and a plurality of light emitting diodes, the light panel removably received within the housing via the opening and positioned with respect to the graphic panel such that the plurality of light emitting diodes of the light panel provide a sole source of illumination to the image from the interior portion of the housing, the light panel removable from the housing via the opening such that the edge-lit panel and the plurality of light emitting diodes are together removed from the housing via the opening as the light panel is removed from the housing.

17. The article of furniture of claim 16, further comprising a moveable access member that provides access to the opening.

18. The article of furniture of claim 16, wherein the housing forms a portion of a headboard for a bed.

19. The article of furniture of claim 16, further comprising a dimmer control mechanism that allows the intensity of the illumination to the image to be changed to a desired level.

20. The article of furniture of claim 19, wherein the dimmer control mechanism is operable such that the intensity of the illumination is selectively changed via wireless control.

* * * * *